US007238002B2

(12) United States Patent
Cairo et al.

(10) Patent No.: US 7,238,002 B2
(45) Date of Patent: Jul. 3, 2007

(54) DAMPER SEAL SYSTEM AND METHOD

(75) Inventors: Ronald Ralph Cairo, Greer, SC (US); Kevin Leon Bruce, Greer, SC (US); Thomas Raymond Farrell, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 85 days.

(21) Appl. No.: 11/265,384

(22) Filed: Nov. 3, 2005

(65) Prior Publication Data

US 2007/0098546 A1 May 3, 2007

(51) Int. Cl.
*F01D 5/20* (2006.01)

(52) U.S. Cl. ..... 415/119; 415/173.3; 416/191

(58) Field of Classification Search ..... 415/119, 415/135, 173.3, 174.2, 173.1; 416/189, 191
See application file for complete search history.

(56) References Cited

U.S. PATENT DOCUMENTS 6,758,653 B2 7/2004 Morrison
6,893,214 B2 5/2005 Alford et al.
6,942,203 B2 * 9/2005 Schroder et al. ..... 415/173.3
7,117,983 B2 * 10/2006 Good et al. ..... 415/173.3
2005/0092566 A1 5/2005 Good et al.
2005/0093214 A1 5/2005 Good et al.
2005/0158168 A1 7/2005 Bruce et al.

OTHER PUBLICATIONS

U.S. Appl. No. 10/455,785, filed Jun. 6, 2003.

* cited by examiner

*Primary Examiner*—Igor Kershteyn
(74) *Attorney, Agent, or Firm*—Nixon & Vanderhye PC

(57) ABSTRACT

A damper and seal system for a stage of a turbine that includes inner shrouds disposed circumferentially of a hot gas path through the turbine stage and shroud body(s) for supporting the inner shroud(s). A damper block engages a backside surface of the inner shroud and a damping mechanism is carried by the shroud body and connected to the damper block for applying a load to the damper block and inner shroud through the engagement of the block with the backside surface of the inner shroud, thereby damping vibratory movement of the inner shroud. The seal system includes at least one primary, integral seal and at least one secondary, non-integral seal to limit axial and radial hot gas leakage through the stage.

20 Claims, 2 Drawing Sheets

DAMPER SEAL SYSTEM AND METHOD

RELATED APPLICATIONS

This application is related to commonly owned U.S. patent application Ser. No. 10/700,251, filed Nov. 4, 2003 for SPRING MASS DAMPER SYSTEM FOR TURBINE SHROUDS, U.S. patent application Ser. No. 10/793,051, filed Mar. 5, 2004 for SUPPORT APPARATUS AND METHOD FOR CERAMIC MATRIX COMPOSITE TURBINE BUCKET SHROUD, U.S. patent application Ser. No. 10/455,785, filed Jun. 6, 2003 for TOP COATING SYSTEM FOR INDUSTRIAL TURBINE NOZZLE AIRFOILS AND OTHER HOT GAS PATH COMPONENTS AND RELATED METHOD, and U.S. patent application Ser. No. 10/758,553 filed Jan. 15, 2005 for METHODS AND APPARATUS FOR COUPLING CERAMIC MATRIX COMPOSITE TURBINE COMPONENTS, the disclosures of each of the above-identified applications are incorporated herein by this reference.

BACKGROUND OF THE INVENTION

It will be appreciated that the shrouds are subject to vibration due to the pressure pulses of the hot gases as each blade or bucket passes the shroud. Moreover, because of this proximity to high-speed rotation of the buckets, the vibration may be at or near resonant frequencies and thus requires damping to maintain life expectancy during long-term commercial operation of the turbine.

Ceramic matrix composites offer advantages as a material of choice for shrouds in a turbine for interfacing with the hot gas path. The ceramic composites offer high material temperature capability. Ceramic composites, however, are difficult to attach and have failure mechanisms such as wear, oxidation due to ionic transfer with metal, stress concentration and damage to the ceramic composite when configuring the composite for attachment to the metallic components.

U.S. application Ser. Nos. 10/700,251 and 10/793,051 provide an attachment mechanism between a ceramic composite shroud and a metallic support structure which utilizes the pressure distribution applied to the shroud, coupled with a loading on the shroud to tune the shroud to minimize damaging vibratory response from pressure pulses of the hot gases as the buckets pass the shrouds.

BRIEF DESCRIPTION OF THE INVENTION

The present invention relates to a damping system for damping vibration of shrouds surrounding rotating components in a hot gas path of a turbine and particularly relates to a sealing scheme for a spring mass damping system for interfacing with a ceramic shroud and tuning the shroud to minimize vibratory response from pressure pulses in the hot gas path as each turbine blade passes the individual shroud.

A sealing scheme for a high temperature component such as a Ceramic Matrix Composite (CMC) shroud that is subject to hot streaks superimposed on high global temperatures must be damage tolerant and robust against leakage to meet intended long-term durability goals. One seal concept is to utilize a single rope of ceramic fibers to effect a seal against a CMC shroud. A single rope does not, however, provide sealing redundancy in the event of excessive chemical or mechanical degradation. In accordance with an aspect of the invention, then, a seal system is provided for a metallic damper that incorporates a plurality of seals to provide sealing redundancy in the event of excessive chemical and mechanical degradation.

Thus, in an example embodiment the invention may be embodied in a damper system for a stage of a turbine comprising: at least one inner shroud disposed circumferentially of a hot gas path through the turbine stage, each said inner shroud having a first surface defining in part a hot gas path through the turbine; a shroud body for supporting said inner shroud; at least one damper block, each engaging a backside surface of a respective said inner shroud opposite said first surface; a damping mechanism carried by said shroud body and connected to said damper block for applying a load to said damper block and said inner shroud through the engagement of the block with the backside surface of the inner shroud thereby damping vibratory movement of said inner shroud; and a seal system including at least one primary, integral seal and at least one secondary, non-integral seal to limit axial and radial hot gas leakage through the stage.

The invention may also be embodied in a damper system for a stage of a turbine comprising: first, second and third shrouds formed of a ceramic material disposed circumferentially side by side and each having a first surface defining in part a hot gas path through the turbine; a shroud body for supporting said shrouds; three damper blocks carried by said shroud body and each engaging a respective said shroud, said damper blocks being formed of a metallic material; damping mechanisms carried by said shroud body and connected to said damper blocks for applying a load to said damper blocks and said shrouds to dampen vibratory movements of said shrouds, each said damping mechanism including a spring for applying the load to said respective damper block; first seals disposed to extend between seal slots defined in respective circumferentially adjacent said damper blocks; and a second seal comprising a circumferential rope seal disposed at a rear of the damper/shroud interface.

Additionally, the invention may be embodied in a method of damping vibratory movement of an inner shroud supported by a shroud body and disposed part circumferentially of a hot gas path through a turbine stage, said inner shroud having a first surface defining in part a hot gas path through the turbine, while limiting axial and radial hot gas leakage through the stage, the method comprising: providing at least one damper block to engage a backside surface of a respective said inner shroud opposite said first surface; providing a damping mechanism carried by said shroud body and connected to said damper block for applying a load to said damper block and said inner shroud through the engagement of the block with the backside surface of the inner shroud thereby damping vibratory movement of said inner shroud; configuring at least one of said damping block to provide at least one primary, integral seal; and providing at least one secondary, non-integral seal, whereby axial and radial hot gas leakage through the stage is limited.

BRIEF DESCRIPTION OF THE DRAWINGS

These and other objects and advantages of this invention, will be more completely understood and appreciated by careful study of the following more detailed description of the presently preferred exemplary embodiments of the invention taken in conjunction with the accompanying drawings, in which.

DETAILED DESCRIPTION OF THE INVENTION

Figure 1:
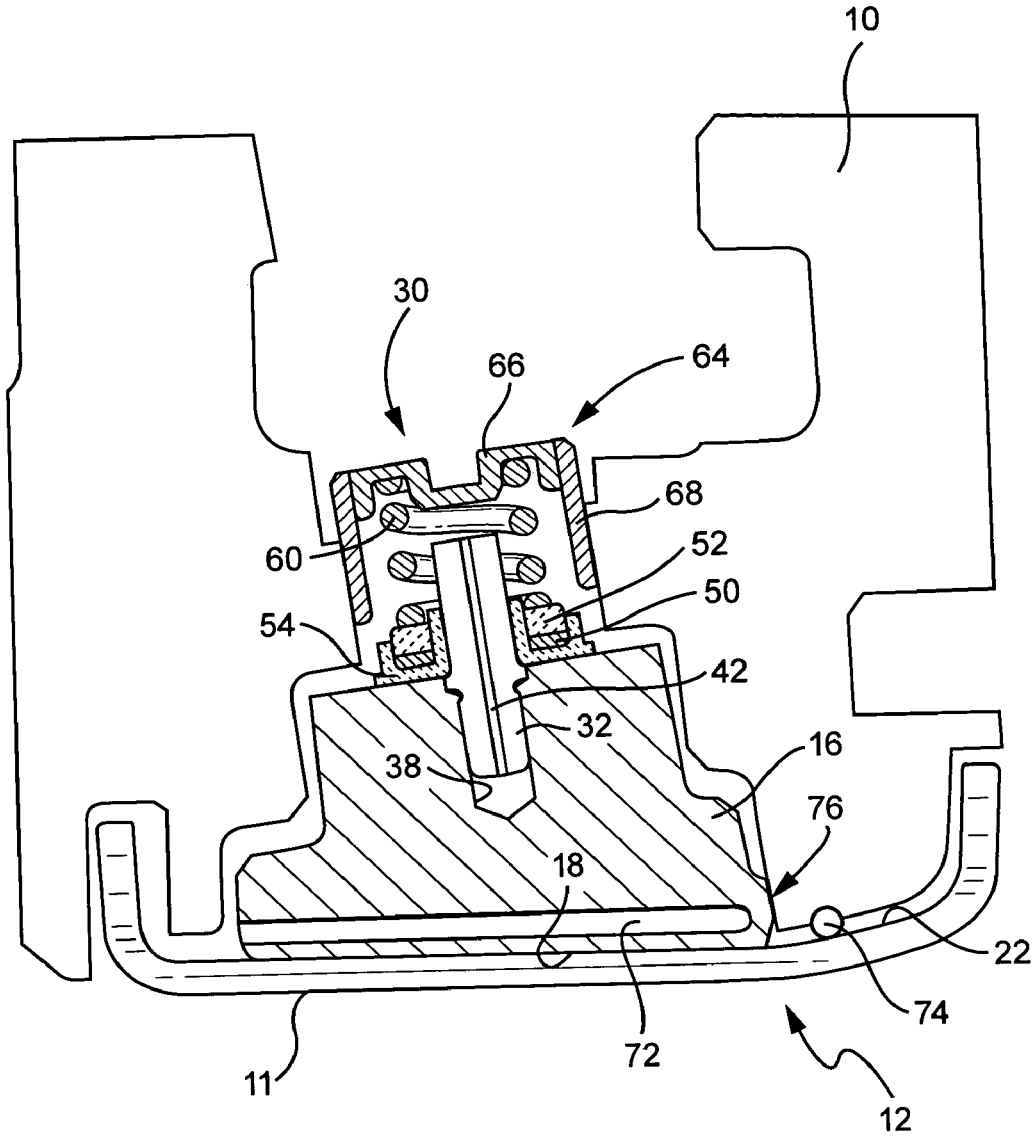
FIG. 1 is a cross-sectional view through an outer shroud block as viewed in a circumferential direction about an axis of the turbine and illustrating an example damper and seal system embodying the present invention.
Figure 2:
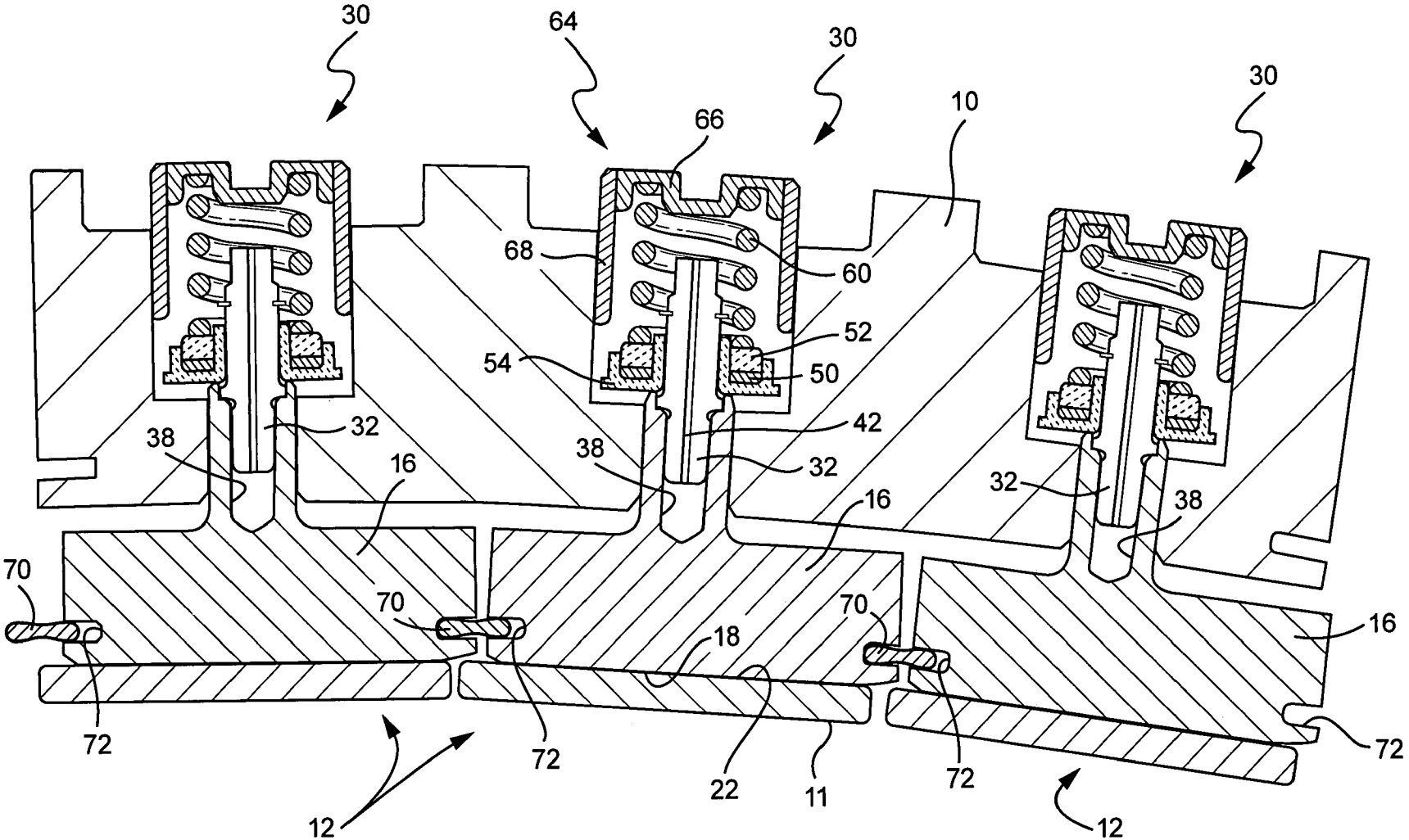
FIG. 2 is a cross-sectional view thereof generally as viewed in an axial aft direction relative to the hot gas path of the turbine.

Referring now to FIGS. 1 and 2, there is illustrated an outer shroud block or body 10 mounting a plurality of shrouds 12. FIG. 1 is a view in a circumferential direction and FIG. 2 is a view in an axial aft direction in the direction of flow of the hot gas stream through the turbine. As seen from a review of FIG. 2, the shroud block 10 carries preferably three individual shrouds 12. It will be appreciated that a plurality of shroud blocks 10 are disposed in a circumferential array about the turbine axis and each mount a plurality of shrouds 12 surrounding and forming a part of the hot gas path flowing through the turbine. The shrouds 12 are formed of a ceramic composite, are secured by bolts, not shown, to the shroud block(s) 10, and have a first inner surface 11 (FIG. 2) in contact with the hot gases of the hot gas path.

The damper system of the present invention includes a damper block/shroud interface, a damper load transfer mechanism and a damping mechanism. The damper block/shroud interface includes a damper block 16 formed of a metallic material, e.g., PM2000, which is a superalloy material having high temperature use limits of up to 2200° F. As illustrated in FIG. 1, in an example embodiment, an integral contact surface is provided between the radially inwardly facing surface 18 of the damper block 16 and a backside surface 22 of the shroud 12.

The damper is designed to damp specific vibratory modes of the shroud. To be effective in this regard, the damper must have a positive pre-load which in the illustrated example embodiment is provided by a metallic spring. More specifically, the damper load transfer mechanism, generally designated 30, includes a piston assembly having a piston 32, the radially inner or distal end of which is received within a complementary socket 38 formed in the damper block 16. A central cooling passage 42 is formed axially along the piston for providing a cooling medium, e.g., compressor discharge air, into the block. The cooling medium, e.g., compressor discharge air, is supplied from a source radially outwardly of the damper block 10 through the damping mechanism described below.

The damper load transfer mechanism also includes, e.g., superposed metallic and thermally insulated washer(s) 50 and 52. The washer(s) are disposed in a cup 54 carried by the piston 32. The washer 50 provides a support for the thermally insulating washer 52, which preferably is formed of a monolithic ceramic silicone nitride. The thermally insulative washer 52 blocks the conductive heat path of the piston via contact with the damper block 12. It will be appreciated that the metallic washer 50 retained by the cup 54 ensures spring retention and preload in the event of a fracture of the insulative washer 52.

The damping mechanism further includes a metallic spring 60. The spring is pre-conditioned at temperature and load prior to assembly as a means to ensure consistency in structural compliance. The spring is preloaded to engage at one end the insulative washer 52 to bias the piston 32 and block 16 radially inwardly. The opposite end of spring 60 engages a cap 64 secured, for example, by threads to the housing. In the illustrated example embodiment, the spring is preloaded by turning a threaded upper spring seat 66 in a threaded spring retention sleeve 68. This assembly, in turn, is threaded to the shroud block 10. The spring reacts through pre-load against the upper spring seat and the lower spring seat. The lower spring seat then loads the damper block 16. The metallic spring is advantageously cooled to prevent permanent creep deformation. Thus, the cap desirably has an opening or a passage (not shown) enabling cooling flow from compressor discharge air to reach the spring and maintain its temperature below a predetermined temperature. As noted above, cooling medium is also supplied to the cooling passage 42 to cool the piston 32 and block 16. Passages (not shown) are provided to exhaust the spent cooling medium.

Sealing the damper blocks in the circumferential, chordal direction is accomplished by a chordal seal 76. The chordal seals are machined in the form of either inclined or rounded surfaces to minimize the chances for the shroud to wedge into the shroud block 16 and prevent effective damping. In the illustrated example embodiment, the entire spring and damper assembly is canted forward to provide positive rearward pressure against the aft chordal seal 76 to maintain damper block position during operation.

The damper's integral features, namely contact between the damper bottom 18 and the (coated) inner shroud surface 22 and the aft chordal contact seals 76 along with inter damper block dog bone cross-section style chute flow seals 70 received in respective integral (machined or cast) seal slots 72 provide a primary sealing function. A rope seal 74, e.g., a single rope of ceramic fibers provides a secondary seal for damage tolerant redundancy.

Thus, in the illustrated example embodiment, a seal system is utilized that incorporates both integral and non-integral features with a metallic damper. The seal surfaces of the damper assembly include the integral contact surface between the damper block and the (coated) surface of the inner shroud which takes advantage of the conformal nature of the Environmental Barrier Coating (EBC)-to-metallic interface, the non-integral, circumferential rope seal 74 at the rear of the damper/shroud interface that provides a redundant axial seal, the integral seal slots 72 that are machined or cast into the damper block 16 to provide positive retention for chute flow seals 70, the integrally machined rear chordal seal 76 that inhibits axial leakage over the top surface of the damper and the canted spring and damper configuration for positive seating of the chordal seal 76 (FIG. 1).

It will be appreciated that in operation, the spring 60 of the damping mechanism maintains a radial inwardly and aft directed force on the piston 32 and hence on the damper block 16. The damper block 16, in turn, bears against the backside surface 22 of the shroud 12 to dampen vibration and particularly to avoid vibratory response at or near resonant frequencies.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A damper system for a stage of a turbine comprising:

at least one inner shroud disposed circumferentially of a hot gas path through the turbine stage, each said inner shroud having a first surface defining in part a hot gas path through the turbine;

a shroud body for supporting said inner shroud;

at least one damper block, each engaging a backside surface of a respective said inner shroud opposite said first surface;

a damping mechanism carried by said shroud body and connected to said damper block for applying a load to said damper block and said inner shroud through the engagement of the block with the backside surface of the inner shroud thereby damping vibratory movement of said inner shroud; and a seal system including at least one primary, integral seal and at least one secondary, non-integral seal to limit axial and radial hot gas leakage through the stage.

2. A system according to claim 1, wherein said secondary, non-integral seal comprises a circumferential rope seal disposed at a rear of the damper/shroud interface.

3. A system according to claim 1, wherein said at least one primary, integral seal comprises an integral contact surface between said damper block and the inner surface of the inner shroud.

4. A system according to claim 1, wherein said inner shroud is formed of a ceramic material and said damper block is formed of a metallic material.

5. A system according to claim 1, wherein said damping mechanism includes a spring and a piston biased by said spring to apply the load to said damper block.

6. A system according to claim 5, wherein said at least one primary, integral seal comprises an integrally machined rear chordal seal between said damper block and said shroud body, whereby axial leakage over a top surface of the damper block is inhibited.

7. A system according to claim 6, wherein said damping mechanism is canted forward to provide positive rearward pressure for said chordal seal.

8. A system according to claim 1, wherein said at least one primary, integral seal comprises at least one integral seal slot defined in said damper block for receiving a chute flow seal.

9. A system according to claim 5 including a housing for said spring in communication with a cooling medium for cooling the spring.

10. A system according to claim 5 further comprising at least one cooling passage along said piston for cooling medium.

11. A system according to claim 5 including a washer about the piston and engaged by the spring, said washer being formed of a thermally insulating material.

12. A damper system for a stage of a turbine comprising:

first, second and third shrouds formed of a ceramic material disposed circumferentially side by side and each having a first surface defining in part a hot gas path through the turbine;

a shroud body for supporting said shrouds;

three damper blocks carried by said shroud body and each engaging a respective said shroud, said damper blocks being formed of a metallic material;

damping mechanisms carried by said shroud body and connected to said damper blocks for applying a load to said damper blocks and said shrouds to dampen vibratory movements of said shrouds, each said damping mechanism including a spring for applying the load to said respective damper block;

first seals disposed to extend between seal slots defined in respective circumferentially adjacent said damper blocks; and a second seal comprising a circumferential rope seal disposed at a rear of the damper/shroud interface.

13. A system according to claim 12, wherein said inner shroud is formed of a ceramic material and said damper block is formed of a metallic material.

14. A system according to claim 13, wherein the damper block integrally contacts a second surface of the inner shroud, thereby to define a seal therebetween.

15. A system according to claim 12, wherein said damping mechanism includes a spring and a piston biased by said spring to apply the load to said damper block.

16. A system according to claim 12, further comprising an integrally machined rear chordal seal between each said damper block and said shroud body, whereby axial leakage over a top surface of the damper block is inhibited.

17. A system according to claim 16, wherein said damping mechanism is canted forward to provide positive rearward pressure for said chordal seal.

18. A method of damping vibratory movement of an inner shroud supported by a shroud body and disposed part circumferentially of a hot gas path through a turbine stage, said inner shroud having a first surface defining in part a hot gas path through the turbine, while limiting axial and radial hot gas leakage through the stage, the method comprising:

providing at least one damper block to engage a backside surface of a respective said inner shroud opposite said first surface;

providing a damping mechanism carried by said shroud body and connected to said damper block for applying a load to said damper block and said inner shroud through the engagement of the block with the backside surface of the inner shroud thereby damping vibratory movement of said inner shroud;

configuring at least one of said damping block to provide at least one primary, integral seal; and providing at least one secondary, non-integral seal, whereby axial and radial hot gas leakage through the stage is limited.

19. The method of claim 18, wherein said configuring comprises integrally machining a rear chordal seal between said damper block and said shroud body, whereby axial leakage over a top surface of the damper block is inhibited, and wherein said damping mechanism is canted forward to provide positive rearward pressure for said chordal seal.

20. The method of claim 18, wherein said configuring comprises forming at least one integral seal slot in said damper block for receiving a chute flow seal to extend between circumferentially adjacent damper blocks.

* * * * *